US009103531B2

(12) United States Patent
De Anna et al.

(10) Patent No.: US 9,103,531 B2
(45) Date of Patent: Aug. 11, 2015

(54) LIGHTING DEVICE WITH BOWL-LIKE CASING

(75) Inventors: Paolo De Anna, Riese Pio X (IT); Alessandro Scordino, Dolo (IT); Lorenzo Roberto Trevisanello, Abano Terme (IT)

(73) Assignee: OSRAM GmbH, Munich (DE)

( * ) Notice: Subject to any disclaimer, the term of this patent is extended or adjusted under 35 U.S.C. 154(b) by 32 days.

(21) Appl. No.: 13/882,461

(22) PCT Filed: Oct. 25, 2011

(86) PCT No.: PCT/EP2011/068624

§ 371 (c)(1), (2), (4) Date: Jun. 4, 2013

(87) PCT Pub. No.: WO2012/055853

PCT Pub. Date: May 3, 2012

(65) Prior Publication Data

US 2014/0146548 A1 May 29, 2014

(30) Foreign Application Priority Data

Oct. 29, 2010 (IT) ..... TO2010A0868

(51) Int. Cl.

| | |
|---|---|
| ***F21V 19/00*** | (2006.01) |
| ***F21V 23/06*** | (2006.01) |
| ***F21K 99/00*** | (2010.01) |
| ***F21V 23/00*** | (2015.01) |
| *F21Y 101/02* | (2006.01) |

(52) U.S. Cl.

CPC ..... *F21V 19/003* (2013.01); *F21K 9/30* (2013.01); *F21V 23/006* (2013.01); *F21V 23/06* (2013.01); *F21Y 2101/02* (2013.01)

(58) Field of Classification Search

CPC .... F21K 9/137; F21V 23/006; F21Y 2101/02
USPC ..... 362/249.01, 249.02, 230, 285, 294
See application file for complete search history.

(56) References Cited

U.S. PATENT DOCUMENTS

| | | | | |
|---|---|---|---|---|
| 6,106,137 | A * | 8/2000 | Adams et al. | 362/237 |
| 7,281,818 | B2 * | 10/2007 | You et al. | 362/241 |
| 7,845,829 | B2 * | 12/2010 | Shaner | 362/249.02 |
| 2005/0128744 | A1 | 6/2005 | You et al. | |
| 2008/0123341 | A1 | 5/2008 | Chiu | |
| 2009/0206718 | A1 | 8/2009 | Shimonishi et al. | |
| 2010/0097806 | A1 | 4/2010 | Kao | |

FOREIGN PATENT DOCUMENTS

| | | |
|---|---|---|
| CN | 101514782 | 8/2009 |
| CN | 101646898 | 2/2010 |

* cited by examiner

*Primary Examiner* — Tracie Y Green
(74) *Attorney, Agent, or Firm* — Cozen O'Connor

(57) ABSTRACT

A lighting assembly (10) comprising: a casing (24) having a bowl-like structure with a bottom wall (24a) defining a window opening (26), and joined to said casing (24), a stack of elements comprising: a light radiation source (12, 14) situated opposite said opening (26) so as to direct said light radiation towards the outside of the casing (24); and a driving circuit board (16) for said radiation source (12, 14).

5 Claims, 3 Drawing Sheets

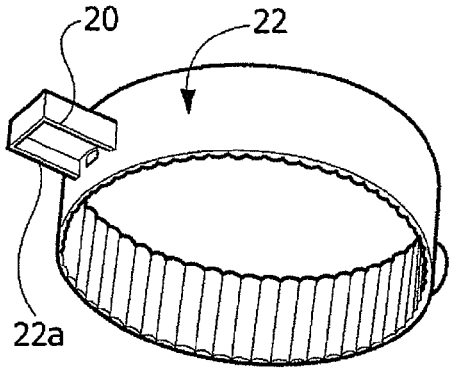
FIG. 6
FIG. 7
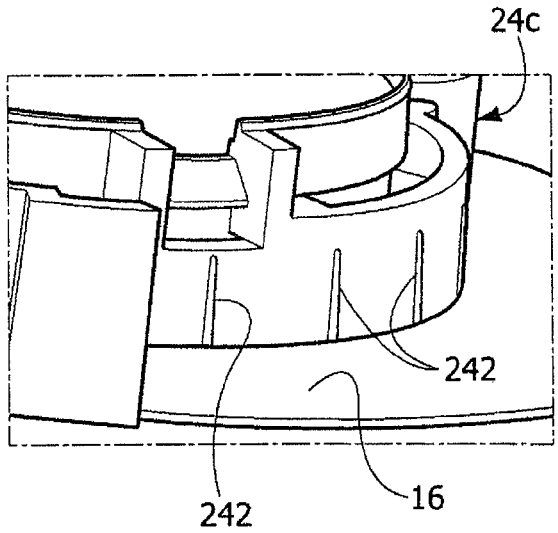
FIG. 8
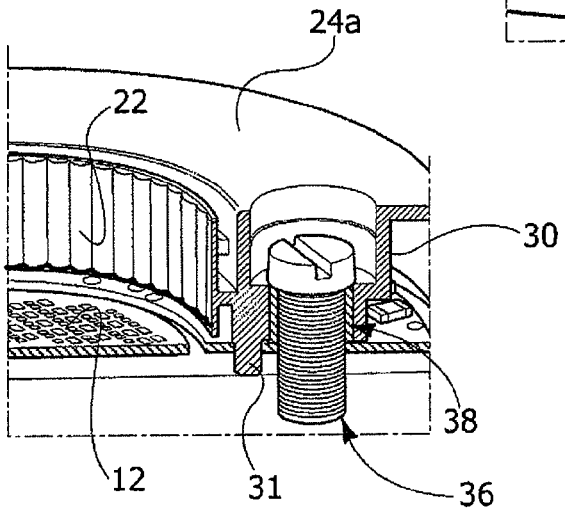
FIG. 9
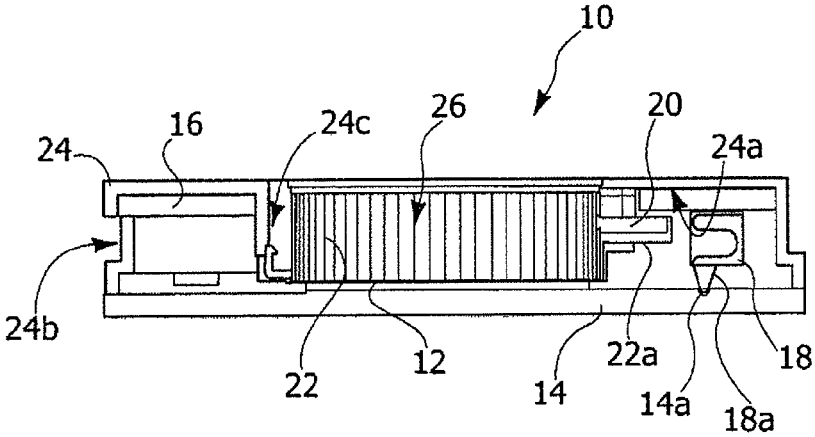

LIGHTING DEVICE WITH BOWL-LIKE CASING

RELATED APPLICATIONS

This is a U.S. national stage of International application No. PCT/EP2011/068624 filed on Oct. 25, 2011.

This patent application claims the priority of Italian application no. TO 2010A000868 filed Oct. 29, 2010, the disclosure content of which is hereby incorporated by reference.

FIELD OF THE INVENTION

The present description relates to lighting assemblies. In various embodiments, the description refers to lighting assemblies which can be used for example for power lighting applications, for example based on the use of LED light radiation sources.

BACKGROUND OF THE INVENTION

In the technical sector in question various designs of lighting assemblies are known, these assemblies being based on structures which can be defined as structures of the non-interactive type, in that they require fairly complex electrical and/or mechanical connections and the use of additional components and processes (for example the provision of cables, joining systems of various kinds, screws, gluing processes, etc.), such that they are unable to guarantee an effective degree of flexibility during assembly/disassembly of the lighting assembly.

This gives rise to complex and bulky designs which are unable to take advantage, for example, of the compact features which are offered by the use of LED light radiation sources. This is the case in particular with regard to the possibility of reducing the complexity of the assembly operations and reducing the overall dimensions.

OBJECT AND SUMMARY OF THE INVENTION

In various embodiments, the description deals with the problem of overcoming the abovementioned drawbacks associated, for example, with possible integration in respect of an LED lighting structure included, for example, in a road lighting system.

The object is thus that of being able to offer, in various embodiments, at least one of the following advantages:

- simplification of the assembly process for various components, such as those including the electronic printed circuit board (PCB) and the substrate of the so-called Chip-on-Board (CoB) for the LEDs;
- a standardized, stable and reliable assembly structure;
- efficient adaptation and adjustment of the tolerances between the parts being assembled;
- integration between the mounting parts and the operative parts (for example as regards the thermal and electrical functions) and
- simplification of assembly and disassembly of an LED lamp unit.

In various embodiments, this object is achieved by means of a lighting assembly having the characteristic features which are described specifically in the claims below.

The claims form an integral part of the technical teaching provided here in relation to the invention.

In various embodiments, a standardized system is obtained where it is possible to use a casing able to provide both the mechanical fixing system and the electrical and optical connection using an additional component which may be, for example, a so-called LED Chip-on-Board (CoB), namely an array of LEDs pre-assembled on a printed circuit board (PCB).

In various embodiments a casing with a compact structure may comprise snap-engaging pins, blocks or parts able to fix in position the electronic board (for example using pre-assembled spring connectors or sliding connections).

In various embodiments the casing may be provided with pins for matching holes in the board which carries the LEDs with the possibility of adjusting the direction of the LED array.

In various embodiments a concentric optical system may be fixed on the casing—using methods which are substantially comparable to a kit assembly method—with the aid of interfering guides or engaging parts able to ensure optical interaction between the optical system and the electronic components present on the electronic board (and, if necessary, a flow sensor included in the device).

In various embodiments it is possible to perform fixing of the parts by means of screws with associated bushes able to provide a connection with the LED light radiation source while ensuring mechanical fixing of all the components as well as the electrical connections.

In various embodiments the electrical contact may be provided by means of spring connections (or sliding contacts) without this requiring additional connection processes.

In various embodiments, the invention described is able to provide a structure having at least one of the following characteristic features:

- a compact and integrated casing design able to allow assembly of an electronic circuit board and a board carrying the light radiation source (for example of the LED type) with the possibility of performing rapidly the mechanical, thermal, electrical and/or optical connection of the components, while ensuring entirely reliable assembly;
- automatic optical centering with the possibility of controlling the lamp unit, for example of the LED type;
- a reliable and standardized connection system; and
- a centering/fixing system, for example of the screw type, able to allow the assembly and/or disassembly operations to be performed more easily and rapidly.

In various embodiments the invention described is able to offer at least one of the following advantages:

- mechanical stability;
- capacity for further development or "future-proofness", provided for example by the possibility of being able to reuse a same LED light radiation source by changing only (for example by means of simple screwing operations) the casing and/or updating the electronic or optical components;
- availability of a connection system such as not to require particular operations/devices (for example welding operations, joining arrangements of various kinds, a cable connection, etc.), so as to increase the reliability of the system, among other things;
- high degree of flexibility during assembly and disassembly, in particular as regards the lamp, for example of the LED type, even at the end of the working life of the lamp itself; and
- possibility of arranging the electronic circuitry and the sensor system at a distance from the substrate intended to dissipate the power of the light radiation source, for example of the LED type, resulting among other things in an improvement of the performance as regards the electromagnetic interference (EMI) and the sensitivity of the detection sensor system (for example for the flow).

BRIEF DESCRIPTION OF THE DRAWINGS

The invention will now be described, purely by way of a non-limiting example, with reference to the accompanying figures in which:

FIGS. 6 to 8 show a number of parts of an embodiment; and

FIG. 9 is a cross-sectional view of an embodiment.

DETAILED DESCRIPTION OF THE DRAWINGS

Figure 1:
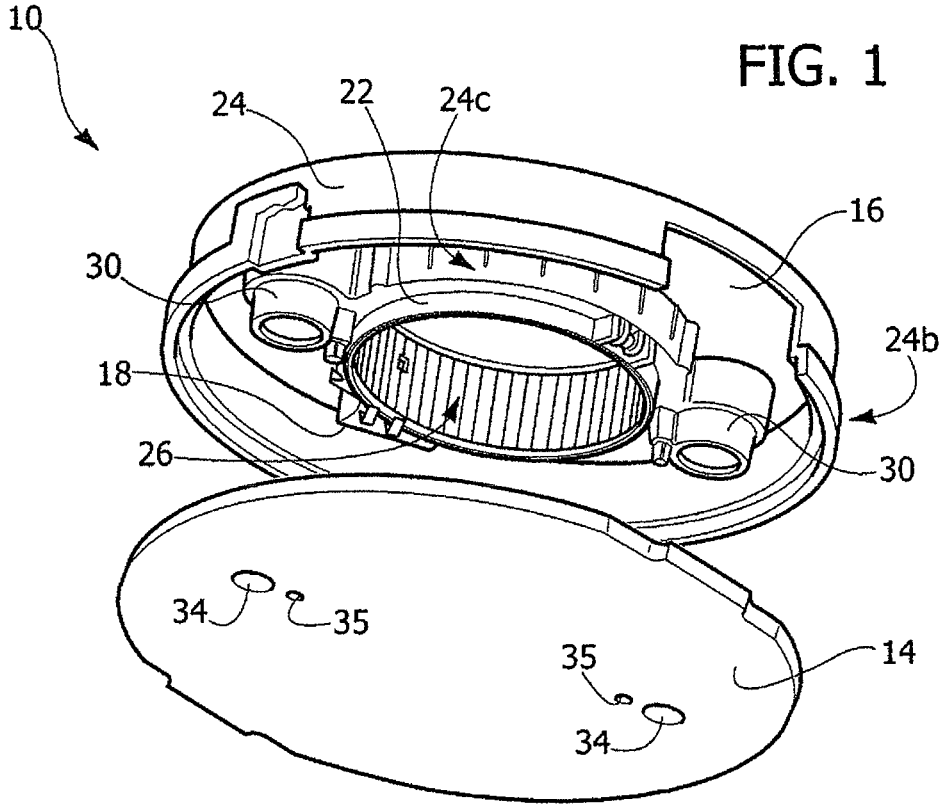
FIG. 1 is a view of an embodiment shown in an exploded condition.
Figure 2:
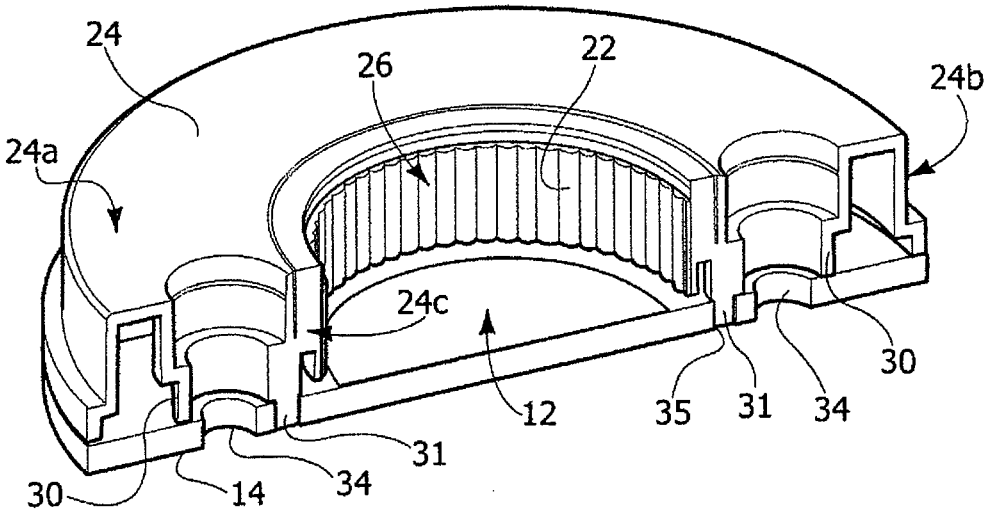
FIG. 2 is a cut-away view of an embodiment shown in an assembled condition.

In the following description various specific details aimed at providing a fuller understanding of the embodiments are described. The embodiments may be implemented without one or more of the specific details or using other methods, components, materials, etc. In other cases, known structures, materials or operations are not shown or described in detail so that the various aspects of the embodiments may be understood more clearly.

The reference to "an embodiment" in the context of this description indicates that a particular configuration, structure or characteristic feature described in relation to the embodiment is included in at least one embodiment. Therefore, phrases such as "in an embodiment", which may occur at various points in this description, do not necessarily refer to the same embodiment. Moreover, particular forms, structures or characteristic features may be combined in any suitable manner in one or more embodiments.

The reference numbers used here are provided solely for the sake of convenience and therefore do not define the scope of protection or ambit of the embodiments.

In the accompanying figures the reference number 10 denotes overall a lighting assembly.

Various embodiments comprise, for example, a lighting assembly which uses an LED light source as a light radiation source. In various embodiments, the source may be in the form of a set of LEDs 12 which are organized in an array namely in a design which is commonly known as "Chip-on-Board", with a support board or board 14.

In the embodiments considered here by way of a non-limiting example, the array of LEDs 12 is shown schematically in the form of a circular board mounted on a similarly circular board 14.

The reference to this particular embodiment must not be interpreted as limiting in any way the scope of the description.

In various embodiments, the board 14 may be for example of the type with a metal core.

In various embodiments, the light radiation source 12, 14 is able to cooperate with a circuit board 16 (for example a printed circuit board (PCB) on which electronic components are mounted) able to be provided with one or more connectors 18 so as to allow the components mounted on the circuit board 16 to cooperate with the board 14 in order to provide an electric power supply to the LED 12 and, if necessary, allow the transmission of corresponding control signals and/or transfer flow detection or sensing signals supplied by a sensor 20 mounted on a support 22 which will be described below.

As already mentioned, in various embodiments, the board 14 may be of the type with a metal core so that it is able to act not only as a base body for the assembly 10, but also partly as a heat sink for dissipating externally the heat produced by the LEDs 12 during operation.

The reference number 24 denotes in its entirety a casing which is for example made of molded plastic and has, in various embodiments, a bowl-like structure.

In various embodiments, the device 10 may have overall a disk-like shape. In various embodiments the casing 24 may have, as shown here, a shape which may be described as being "doughnut-like".

The choice of this particular form must not, however, be interpreted as being obligatory for the purposes of implementation of the embodiments. In various embodiments, the casing 4 (and therefore the assembly 10 as a whole) could have a different form, for example a square, rectangular or prismlike shape. With all of these forms the casing 24 retains an overall bowl-like configuration in which a bottom wall 24*a* may be identified.

In various embodiments, in addition to an outer peripheral wall 24*b*, the bottom wall 24*a* may be bounded internally by a wall 24*c* defining a window 26 (which is central in the embodiment considered here by way of example) having, at least partly facing it, in the mounted assembly 10, the array of LEDs 12, i.e. the light radiation source, so that said radiation source is able to be emitted outside of the assembly 10 through the window 26.

In various embodiments the radiation source 12, 14 and the board 16 may be joined to the casing 24 in a general stack-like assembly structure.

In the embodiments considered here by way of example, the organization of the aforementioned stack is such that the board 16 is arranged adjacent to the bottom wall 24*a* of the bowl-like structure of the container 24 and is thus arranged between the bottom wall 24*a* of the casing 24 and the light radiation source 12, 14, with the board 14 which basically acts as a lid or cover for the casing 24.

In various embodiments, both the board 16 and the board 14 and the radiation source 12, 14 may both be fitted onto the internal wall formation 24*c* of the casing 24.

In various embodiments, as considered here for example, the board 16 may have a general ring-like form and be fitted around the wall formation 24*c*, while the board 14 is also fitted onto the aforementioned wall formation 24*c*, but in an end position, in conditions such as to ensure centering of the array of LEDs 12 with the window 26 of the casing 24.

Figure 3:
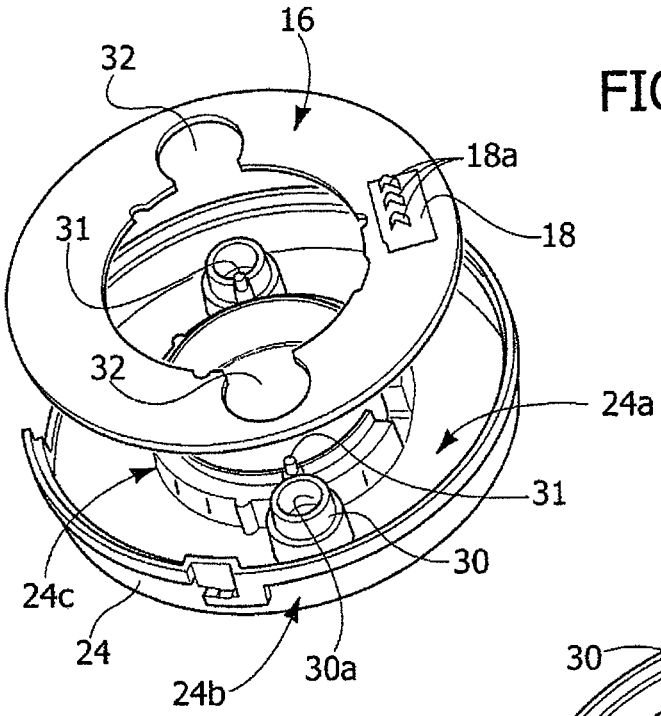
FIGS. 3 to 5 show various stages in a sequence for assembly of an embodiment.
Figure 4:
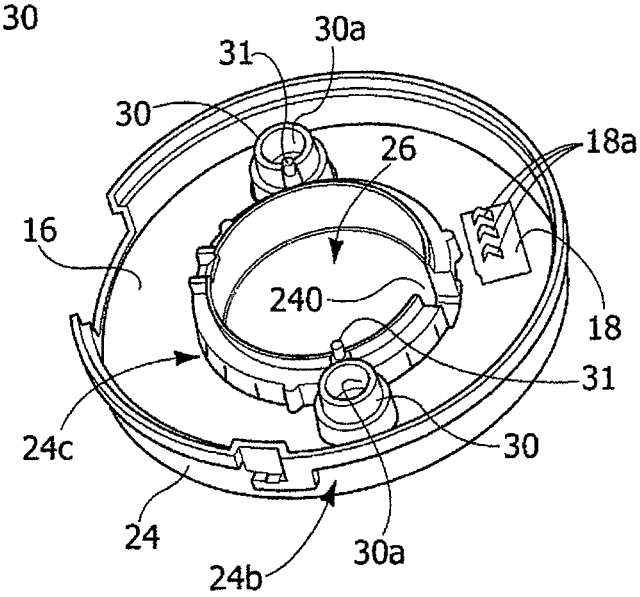
Figure 5:
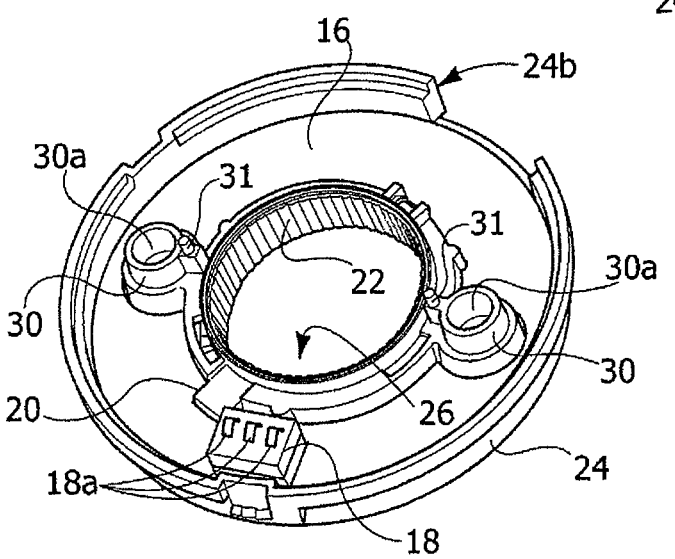

With reference to the assembly sequence shown in FIGS. 3 to 5, the possible presence, within the casing 24, of engaging formations, for example in the form of pins 30, 31, may be noted. These formations protrude from the bottom wall 24*a* of the casing 24 and are intended to extend through corresponding openings provided in the board 16 (for example in the form of notches 32) aligned with holes 34 and 35 provided in the board 14.

In the embodiments considered here by way of example, the pins 31 extend through the openings 35 in the board 14 with a relative centering function. The pins 30 may instead rest in a distal position against the board 14 and each be passed through by an axial through-cavity 30*a* for a screw 36 which screws into a corresponding opening 34 in the board 14 so as to allow fixing of the casing 24 to the board 14 with the board 16 arranged between the bottom wall 24*a* of the casing and the board 14.

In various embodiments, the screws 36 may extend through the axial cavities 30*a* of the pins 30 with bushes 38 arranged in between. In various embodiments, the screws 36 (or similar fixing means) may consist at least partly of an electrically conductive material so as to form conductive paths towards the lighting source 12, 14.

In various embodiments (see for example the cross-sectional view in FIG. 9), the connector 18 may be provided with spring contacts 18*a* able to ensure electrical connection between the circuits mounted on the board 16 and the board 14 (and therefore the LEDs 12), for example engaging in one or more grooves 14*a* provided in the surface of the board 14 directed towards the inside of the casing 24.

FIG. 6 shows in greater detail a possible structure of the support element 22 for the flow sensor 20, if present. In various embodiments, the support 22 is able to be inserted inside the window 26 of the casing 24, being for example inserted inside the wall formation 24*c* with a bracket element 22*a* intended to carry the sensor 20 and projecting radially from the support 22 through a notch or incision 240 provided in the wall formation 24*c* (see in particular FIG. 4). It is thus possible to perform reliable flow measurements by means of the optical sensor 20 since this is not influenced significantly by the heat dissipation of the LEDs.

FIG. 7 shows how, in various embodiments, the wall formation 24*c* may be provided externally with ribs 242 which are directed so that the board 16 is fitted onto the wall formation 24*c* in an interfering arrangement.

Obviously, without affecting the principle of the invention, the constructional details and embodiments may vary, also significantly, with respect to that illustrated here purely by way of a non-limiting example, without thereby departing from the scope of the invention as defined in the accompanying claims.

The invention claimed is:

1. A lighting assembly comprising:

a casing having a bowl-like structure with a bottom wall defining a window opening, and joined to said casing, a stack of elements comprising:

a light radiation source situated opposite said opening so as to direct said light radiation towards the outside of the casing; and a driving circuit board for said radiation source, wherein said opening is surrounded by a wall-like formation of said casing with at least one of said circuit board and said radiation source fitted onto said wall formation.

2. The assembly according to claim 1, comprising a sensor element mounted on a support member joined to said casing, and wherein said support member is a ring-like formation joined to said wall formation.

3. The assembly according to claim 1, wherein both of said circuit board and said radiation source are fitted onto said wall formation.

4. A lighting assembly comprising:

a casing having a bowl-like structure with a bottom wall defining a window opening, a sensor element mounted on a support member joined to said casing, and joined to said casing, a stack of elements comprising:

a light radiation source situated opposite said opening so as to direct said light radiation towards the outside of the casing;

a driving circuit board for said radiation source.

5. A lighting assembly comprising:

a casing having a bowl-like structure with a bottom wall defining a window opening, joined to said casing, a stack of elements comprising:

a light radiation source situated opposite said opening so as to direct said light radiation towards the outside of the casing; and a driving circuit board for said radiation source, and elastic biasing means acting on said circuit board so as to push said circuit board towards said bottom wall of the casing, wherein said elastic biasing means comprise electrical contacts which form an electrical connection for said circuit board.

* * * * *